US008133041B2

(12) United States Patent
Ludlow et al.

(10) Patent No.: US 8,133,041 B2
(45) Date of Patent: Mar. 13, 2012

(54) SUBSEA CHEMICAL INJECTION SYSTEM AND PUMPS THEREFOR

(75) Inventors: Jeremy Leonard Clive Ludlow, Hampshire (GB); Jonathan Geoffrey Gore, Hampshire (GB); Adrian Robert Bowles, Hampshire (GB); Mark Gregory Maylin, Hampshire (GB); Richard Carson McBride, Hampshire (GB); Abdul-Salam Kaddour, Hampshire (GB); Ahmed Yehia Amin Abdel-Rahman, Hampshire (GB)

(73) Assignee: Qinetiq Limited (GB)

( * ) Notice: Subject to any disclaimer, the term of this patent is extended or adjusted under 35 U.S.C. 154(b) by 355 days.

(21) Appl. No.: 12/521,157

(22) PCT Filed: Dec. 21, 2007

(86) PCT No.: PCT/GB2007/004940

§ 371 (c)(1),
(2), (4) Date: Jun. 25, 2009

(87) PCT Pub. No.: WO2008/081164

PCT Pub. Date: Jul. 10, 2008

(65) Prior Publication Data

US 2010/0074776 A1 Mar. 25, 2010

(30) Foreign Application Priority Data

Jan. 4, 2007 (GB) ..... 0700114.2

(51) Int. Cl.
*F04B 17/03* (2006.01)
*F04B 53/00* (2006.01)

(52) U.S. Cl. ..... 417/415; 417/322; 92/60.5

(58) Field of Classification Search ..... 417/415, 417/322, 413.2, 274; 92/60.5, 169.1
See application file for complete search history.

(56) References Cited

U.S. PATENT DOCUMENTS

| | | | | |
|---|---|---|---|---|
| 2,647,683 | A * | 8/1953 | Schweller | 417/571 |
| 3,194,162 | A * | 7/1965 | Williams | 417/322 |
| 3,598,506 | A | 8/1971 | O'Neill | |
| 4,471,256 | A * | 9/1984 | Igashira et al. | 310/328 |
| 4,907,748 | A * | 3/1990 | Gardner et al. | 239/584 |
| 4,927,334 | A * | 5/1990 | Engdahl et al. | 417/322 |
| 5,816,780 | A | 10/1998 | Bishop et al. | |
| 2003/0034899 | A1 | 2/2003 | Zisk, Jr. | |
| 2005/0214132 | A1 * | 9/2005 | Harashima et al. | 417/212 |
| 2006/0096760 | A1 | 5/2006 | Ohmer | |
| 2006/0153713 | A1 | 7/2006 | Dooley | |

FOREIGN PATENT DOCUMENTS

| | | |
|---|---|---|
| GB | 2213536 | 8/1989 |
| WO | WO 03/058066 | 7/2003 |

* cited by examiner

*Primary Examiner* — Devon C Kramer
*Assistant Examiner* — Ryan Gatzemeyer
(74) *Attorney, Agent, or Firm* — McDonell Boehnen Hulbert & Berghoff LLP

(57) ABSTRACT

A high pressure pump for use in the injection of liquid chemicals into subsea oil or gas wells, and intended to be positioned in the subsea environment adjacent to the wellhead, comprises a piezoelectric actuator (19) for reciprocating a plunger (22) which acts to compress and expand the effective volume of a pumping chamber (29) having a valved inlet (15) connected to a source of the liquid and a valved outlet (16) to lead the liquid to the well. The device has a minimum of moving parts and in particular avoids the need for any rotating parts and attendant high performance bearings and seals.

9 Claims, 4 Drawing Sheets

SUBSEA CHEMICAL INJECTION SYSTEM AND PUMPS THEREFOR

BACKGROUND OF THE INVENTION (1) Field of the Invention

The present invention relates to a system for injecting liquid chemical into a subsea well and to pumps designed for use in such a system. Although the term "subsea" is used for convenience to indicate the location of wells to which the system relates, this should be understood to include reference to any substantial body of water beneath which a well may be located. Furthermore pumps of the character to be more particularly disclosed herein are not restricted to use in such systems and may also find application in, for example, automotive fuel injection systems, hydraulic actuator systems, or in other areas where high fluid pressures need to be generated by electrically-powered pumps with a minimum of moving parts.

(2) Description of the Art

It is a well known practice, in order to maintain the efficient operation of a production oil or gas well, to inject certain chemicals in liquid form into the well at selected times and positions, for example corrosion inhibitors to inhibit corrosion of downhole equipment and wax inhibitors to inhibit the formation of waxy substances that block the flow of product. For high pressure, high temperature (HPHT) wells and extremely high pressure, high temperature (XHPHT) wells, pressures typically in the range of 15,000-25,000 PSI (100-170 MPa) need to be generated by the pumps in such systems. In the case of subsea wells it is not always practical to have pumps at the surface platform (or only at the surface platform) due to the cost of running high pressure umbilicals down to the wellheads (which can involve umbilical lengths of some thousands of meters) and the pressure drop across such long umbilicals, meaning that control of the delivery pressures and flow rates at the wellheads can be quite problematic. It is therefore common to employ the pumps (or additional pumps) for such systems underwater in the vicinity of the wellheads. However, a subsea environment presents particularly serious challenges to the reliability of such chemical injection pumps due to the aggressive conditions under which they are required to operate and the difficulty of accessing and effecting any required maintenance or repair of the equipment located underwater. Current systems typically employ hydraulically-actuated pumps, requiring hydraulic control lines to be run down to the sea bed, and regular maintenance, and are therefore both complex and costly to operate. The present invention therefore aims to provide an alternative pumping system for such service, which can be electrically operated, has a minimum of moving parts and in particular avoids the need for any rotating parts and attendant high performance bearings and seals; in other words an essentially "solid state" solution.

SUMMARY OF THE INVENTION

In one aspect the present invention accordingly resides in a system for injecting liquid chemical into a subsea well comprising:

a source of liquid chemical;

a pump located in the subsea environment comprising a pumping chamber, an inlet and an outlet opening to said chamber, a reciprocal plunger adapted to compress and expand the effective volume of said chamber, and a piezoelectric actuator for reciprocating said plunger;

conduit means for leading liquid chemical from said source to said inlet of said pump; and conduit means for leading liquid chemical from said outlet of said pump to said well.

The invention also resides per se in various features of the pump to be more particularly described and illustrated herein.

DESCRIPTION OF THE DRAWINGS

The invention will now be more particularly described, by way of example only, with reference to the accompanying drawings in which.

DESCRIPTION OF THE INVENTION

Figure 1:
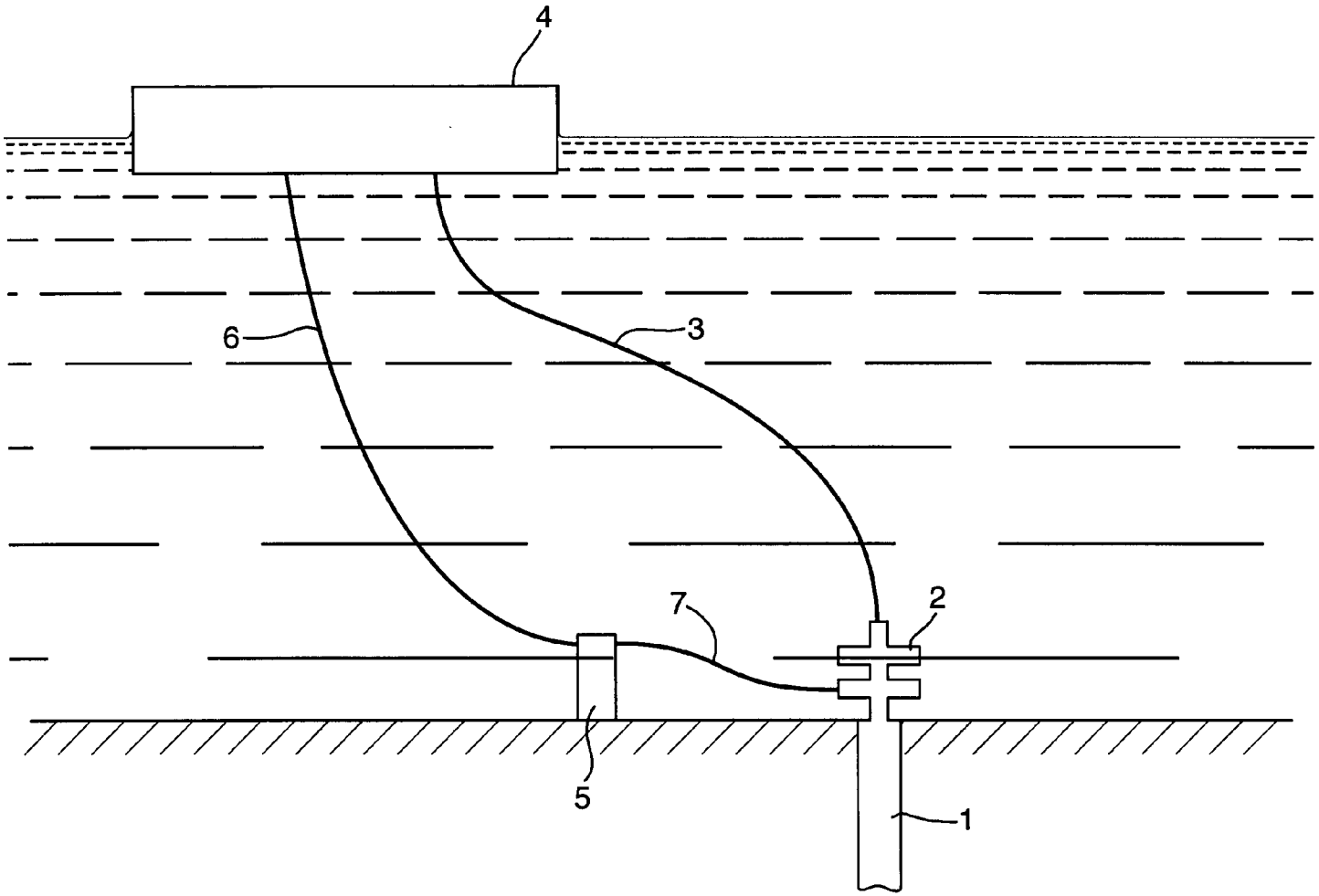
FIG. 1 is a schematic diagram of a subsea chemical injection system according to the invention.

Referring to FIG. 1, this illustrates schematically one example of a system according to the invention. There is shown an oil or gas wellbore 1 extending down from the sea floor and equipped with a wellhead 2 from which product flows through tubing 3 to a production platform 4 at the surface. Although the platform 4 is shown as a floating (offshore) platform in the Figure, depending on the topography of the oil or gas field it could alternatively be a land-based platform serving the subsea well /1;2. Adjacent to the wellhead there is a unit 5 housing one or more—and in practice most likely to be a multiplicity acting in series and/or parallel—of pumps of the kind described below, for use in injecting liquid chemical into the well. The chemical or chemicals to be injected are stored on the platform 4 and supplied to the unit 5, partially pre-pressurised if required, through an umbilical 6 which also carries electrical power and any required data and/or control signals to the pumping unit. Tubing 7 conveys the chemical for injection from unit 5 to the wellhead whence it is distributed as required.

Figure 2:
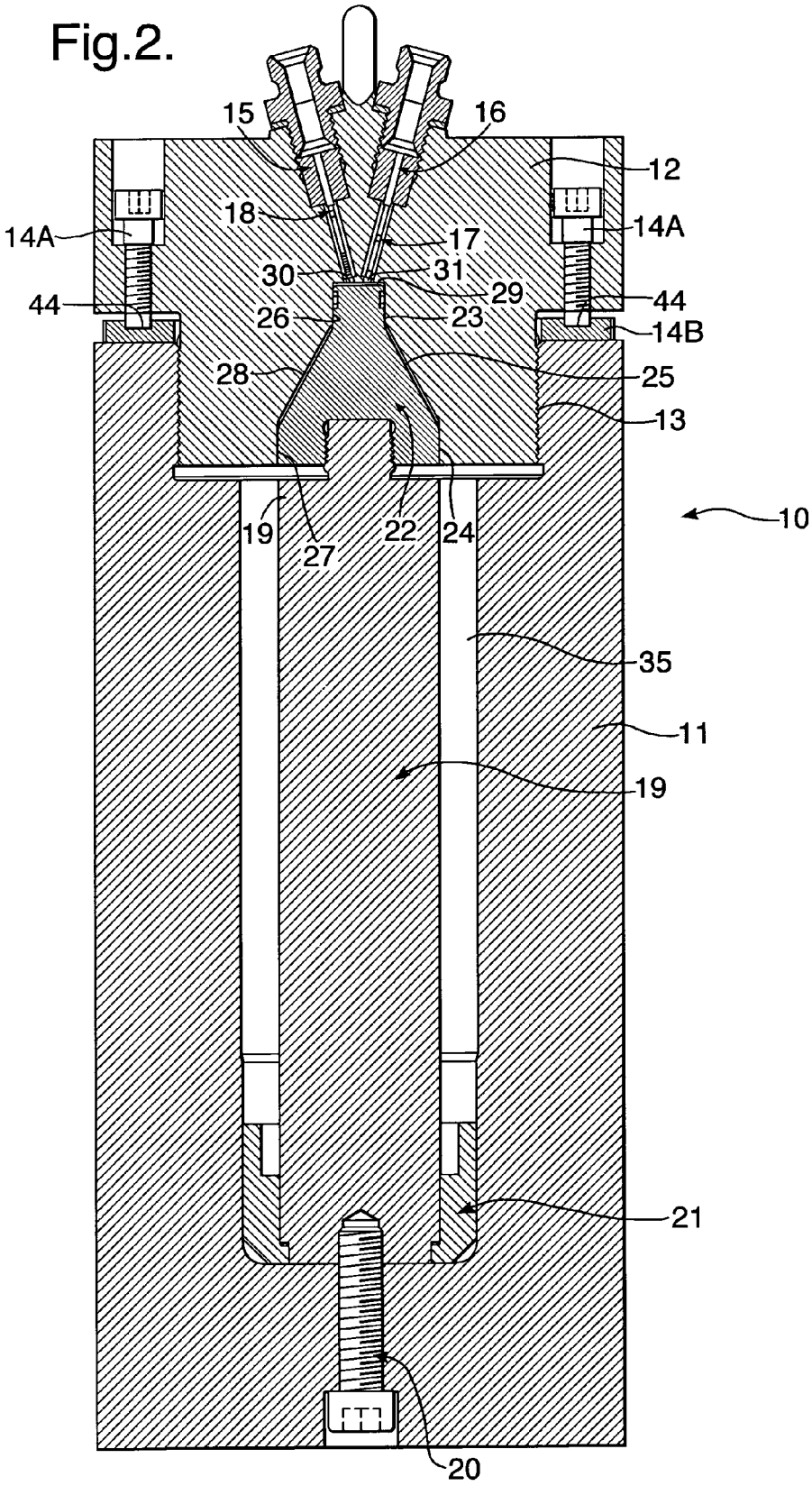
FIG. 2 is a longitudinal section through one embodiment of a pump according to the invention for use in the system of FIG. 1.
Figure 3:
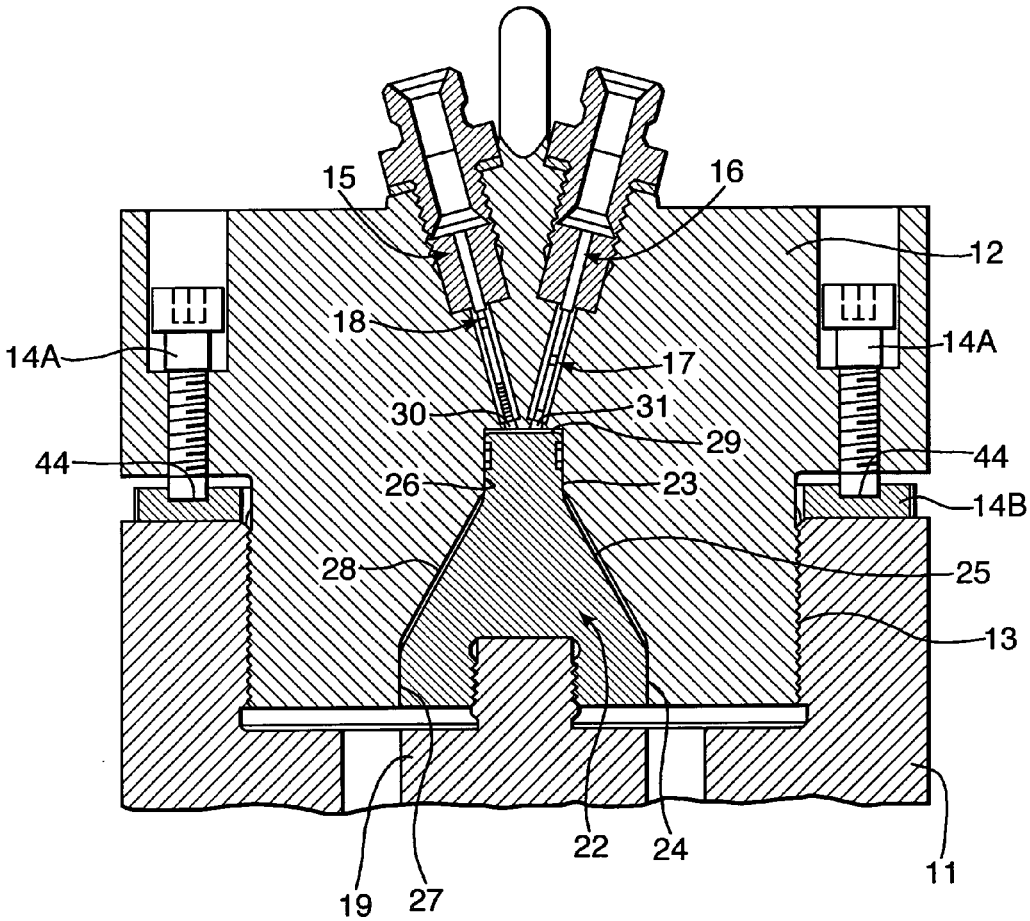
FIG. 3 shows the plunger and head portion of the pump of FIG. 2, to an enlarged scale.

FIGS. 2 and 3 illustrate the structure of one embodiment of a pump 10 for use in the unit 5. It has a barrel-like body part 11 typically of stainless steel, closed by a monolithic head 12 typically of a nickel-based alloy such as Hastelloy® for resistance to the chemicals which will be handled by the pump. The head 12 is attached to the body part 11 through mating fine pitched screw threads 13 and secured in place by a set of, say, six clamping bolts 14A pressing on a ring 14B on top of the body part 11, as will be more particularly explained hereafter. The head 12 has inlet and outlet fittings 15 and 16 for the chemical to be pumped, fitted with respective micro non-return valves 17, 18 and leading to/from the pumping chamber referred to below.

Within body part 11 is mounted an elongate piezoelectric actuator 19, being fixed at its base by a screw 20. In this respect the actuator 19 sits in a cradle 21 at its base equipped with flats to prevent rotation of the actuator as the screw 20 is tightened. This actuator comprises a stack of piezoelectric ceramic discs (not individually shown) within a housing, preloaded by an internal spring (also not shown), which when energized expand in the longitudinal direction of the stack with a maximum strain rate of around 0.1% of the length of the stack, and return to their unstrained condition, with assistance from the spring, when the energising voltage is removed. By applying voltage pulses to the actuator, therefore, its free end (upper end as viewed in the Figures) can be caused to reciprocate at the frequency of the pulses. Leads carrying the energising voltage to the actuator are routed through a radial bore in the body part 11 (not shown). Actuators of this kind are commercially available and typically used for generating mechanical vibrations at sonic frequencies e.g. for sonar equipment.

Rigidly screwed to the free end of the actuator 19 is a plunger 22, typically of Hastelloy®, which consequently also reciprocates in use in accordance with the energisation of the actuator. The plunger 22 is formed at its upper and lower ends with narrower and wider cylindrical surfaces 23 and 24, joined by a frustoconical surface 25. The surfaces 23 and 24 are a close sliding fit in correspondingly bored portions 26 and 27 of the head 12 and the bores 26 and 27 are joined by an internal frustoconical surface with clearance around the surface 25 of the plunger to define a small space 28 and accommodate the reciprocation of the plunger. A small pumping chamber 29 is defined between the topmost surface of the plunger 22 and the facing surface of the head 12, through which ports 30 and 31 open from the valves 17 and 18. As the plunger is reciprocated by energisation of the actuator 19, therefore, its upper end acts as a piston to alternately compress and expand the volume of the chamber 29. More particularly movement of the plunger to the top of its stroke compresses the volume of the chamber 29, causing the valve 18 to open and expelling the contents of the chamber towards the outlet 16. As the plunger 22 returns to the bottom of its stroke the volume of the chamber 29 is expanded so that the valve 18 closes, the valve 17 opens and a fresh quantity of chemical enters the pumping chamber from the inlet 15.

Figure 4:
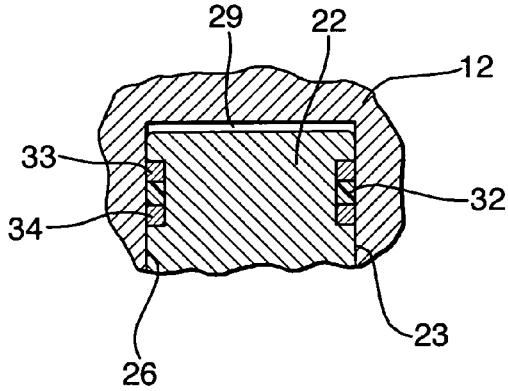
FIG. 4 is a scrap section showing the sealing arrangement of the plunger to the head in the pump of FIG. 2, to a further enlarged scale.

In this respect the upper end (piston) of the plunger 22 is sealed against the bore 26 of the head 12 as shown in FIG. 4 (from which the ports 30 and 31 are omitted for simplicity). That is to say the plunger surface 23 is formed with a groove in which is located an "O" ring 32 e.g. of Viton® which is slightly compressed in the radial direction when fitted in the head 12 and forms a sliding seal against the bore 26 as the plunger reciprocates. This ring is supported on each side by a PTFE back up ring 33, 34 of substantially the same effective radial thickness as the compressed "O" ring 32 so there is no danger of the "O" ring becoming damaged by extrusion against any sharp edges in use. The fit of the plunger surface 24 (FIGS. 2 and 3) in the bore 27 of the head 12 ensures that the piston portion of the plunger remains centralised in the bore 26 and further assures that the piston is evenly sealed around the head as it reciprocates. The head 12 is itself machined from a monolithic block and provides no leakage path for liquid from the pumping chamber 29.

In use the pump 11 will be immersed in a bath of hydraulic fluid and bores (not shown) through the body part 11 convey this fluid to the space 35 around the piezoelectric stack 19 for cooling the same. Circulation of this fluid to enhance cooling may occur through natural convective flow or an additional small conventional circulating pump (not shown) may be provided for this purpose. Bores (not shown) through the head 12 also convey this fluid to the space 28 around the plunger 22 for lubricating the movement of the plunger, the seal 32 also serving to keep this fluid out of the pumping chamber 29.

It will be appreciated that by virtue of the limited stroke length of the actuator 19 and corresponding size of the pumping chamber 29 only a small volume of liquid will be pumped in each cycle, although the total flow rate is of course a function of the actuation frequency. By way of example, a single pump substantially as illustrated, with an actuator length of 200 mm and stroke of 0.2 mm, has been found to be capable of pumping liquid at a rate of up to 5 liters per hour at an outlet pressure of up to 20,000 PSI (140 MPa) from an inlet pressure of up to 10,000 PSI (70 MPa) when actuated at between 30 and 70 Hz, and substantially higher rates and/or pressures should be achievable by ganging a plurality of such pumps together. The ratio of the swept volume of the pumping chamber 29 to its total volume (including the volume of the ports 30, 31 and any "dead" space between the valves 17, 18) will be at least 1:7.

Figure 5:
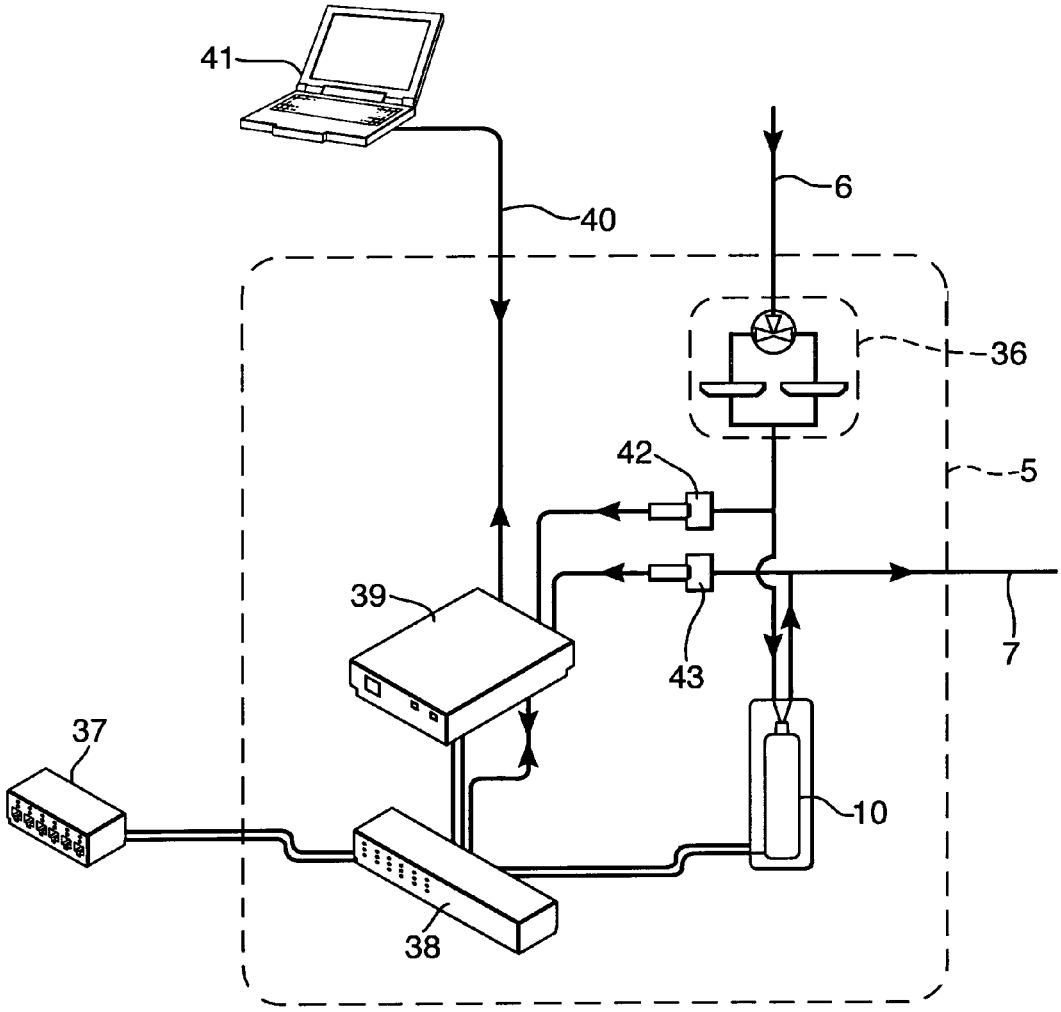
FIG. 5 illustrates schematically a control system for the pump of FIG. 2.

A typical control system for the pump 10 within a unit 5 is illustrated in FIG. 5. The pump is shown connected to the chemical supply line (umbilical) 6 through an inline filter system 36 for removing any debris that may accumulate from the long umbilical, and to the chemical output line 7. The pump is energised from an electrical power supply 37 via a driver unit 38 under the control of a driver control unit 39 which is itself linked by a two way data and control line 40 to a topside control unit 41 using any standard serial communication technique (e.g. RS422/RS485). Transducers 42 and 43 monitor the pressures in the supply and output lines, from which the flow rate can also be computed. The control unit 39 controls the driver 38 to energise the pump 10 to inject the chemical as demanded by the topside controller, to achieve a desired flow rate by control of the applied voltage amplitude, duty cycle and/or frequency.

The assembly of the pump shown in FIGS. 2-4 is achieved as follows. First the plunger 22 is fitted to the actuator 19, the actuator is slid into the cradle 21 in the body part 11, with its leads routed as required, and the bolt 20 is loosely fitted Next the "O" ring 32 and back up rings 33, 34 are fitted to the plunger 22 and the clamping ring 14B is placed on the body part 11. The inside surfaces of the head 12 are then lubricated and the head is screwed onto the body part 11 ensuring that it is correctly located over the plunger 12 but not screwed all the way down. The bolt 20 is then tightened and the head 12 is screwed further until it abuts the top surface of the plunger 22. The clamping bolts 14A are fitted into the head 12 and turned to engage loosely in respective cups 44 formed in the ring 14B. The head 12 is then backed off from the top of the plunger by turning it in the reverse direction through a specified arc to define the required depth of the pumping chamber 29—to facilitate which the clamping ring 14B (which now turns on the body part 11 with the head 12 by virtue of its engagement with the bolts 14A) is provided with a series of markings around its periphery which can be related to an index mark on the body part 11. Finally the bolts 14A are tightened to take up any play in the screw threads 13 and to clamp the head 12 against the body part 11 in the relative rotational position to which it has been set. This process ensures that the volume of the pumping chamber 29 is consistent from pump to pump notwithstanding any variations which may exist in the axial lengths of the actuators 19 or other engineering tolerances on the plunger and head profiles.

A feature of the pump 10 described and illustrated herein is that the plunger 22 is connected directly to the actuator 19 and avoids the use of any lever or the like force —or movement-amplifying means. In the described chemical injection system the pump also acts directly on the liquid to convey it towards the injection point(s) in the well as distinct from a system where, say, a piezoelectric pump is used to pressurise a hydraulic fluid for operation of a ram or the like.

The pump 10, being a positive displacement pump, can also usefully function as a metering unit by controlling the frequency or other characteristic of operation of the piezoelectric actuator, meaning that separate orifice plates or the like devices need not be employed for this purpose. Indeed such a pump can be used as a metering unit even in the case where it is not required to provide, or boost, the pressure of the system, then simply controlling the rate of flow of fluid though it under a separately-generated pressure differential.

The invention claimed is:

1. A system for injecting liquid chemical into a subsea well comprising:

a source of liquid chemical;

a pump located in the subsea environment comprising a pumping chamber, an inlet and an outlet opening to said chamber, a reciprocable plunger adapted to compress and expand the effective volume of said chamber, and a piezoelectric actuator for reciprocating said plunger;

an inlet conduit for leading liquid chemical from said source to said inlet of said pump; and an outlet conduit for leading liquid chemical from said outlet of said pump to said well wherein said pump further comprises a body structure within which said piezoelectric actuator is housed and a head structure which defines said pumping chamber together with said plunger, and means for selecting the volume of said pumping chamber by relative movement between said head structure and said body structure, and means for retaining said head structure in a selected relative position.

2. A pump comprising a pumping chamber, an inlet and an outlet opening to said chamber, a reciprocable plunger adapted to compress and expand the effective volume of said chamber, and a piezoelectric actuator for reciprocating said plunger, a body structure within which said piezoelectric actuator is housed and a head structure which defines said pumping chamber together with said plunger and means for selecting the volume of said pumping chamber by relative movement between said head structure and said body structure, and means for retaining said head structure in a selected relative position.

3. The pump according to claim 2 wherein said actuator is of elongate form and is adapted to output linear movement in the longitudinal direction thereof, said plunger being attached to said actuator to directly adopt the movement thereof.

4. The pump according to claim 2 wherein said plunger is adapted to slide in the head structure having an internal surface which faces an axial end surface of said plunger and defines a margin of said pumping chamber, with inlet and outlet passages extending through said head structure and opening into said pumping chamber through said internal surface thereof.

5. The pump according to claim 4 wherein respective non return valves are installed within said inlet and outlet passages.

6. The pump according to claim 4 wherein said head structure also has a cylindrical wall surface against which said plunger is slidably sealed, said internal surface and said cylindrical wall surface of said head structure being present in the same piece of material.

7. The pump according to claim 2 wherein said plunger comprises external cylindrical wall surfaces of greater and lesser diameters at opposite axial ends thereof which are adapted to slide against complementary internal cylindrical wall surfaces of the head structure.

8. The pump according to claim 7 wherein said complementary internal cylindrical wall surfaces are present in the same piece of material.

9. The pump according to claim 7 wherein said external wall surface of lesser diameter is at an axial end of said plunger adjacent to said pumping chamber.

* * * * *